United States Patent [19]

Müller

[11] Patent Number: 4,523,446

[45] Date of Patent: Jun. 18, 1985

[54] MACHINE FOR THE DEEP SLITTING OF THE PERIPHERY OF NON PLANAR DISCS USED FOR PROVIDING WHEELS HAVING A PNEUMATIC TIRE

[75] Inventor: Roger Müller, Neuilly sur Seine, France

[73] Assignee: Elermetal, Paris, France

[21] Appl. No.: 432,092

[22] Filed: Sep. 30, 1982

[30] Foreign Application Priority Data

Dec. 29, 1981 [FR] France ..... 81 24389
Mar. 18, 1982 [FR] France ..... 82 04599

[51] Int. Cl.[3] ..... B21H 1/02

[52] U.S. Cl. ..... 72/71; 72/101; 72/102

[58] Field of Search ..... 72/70, 71, 81, 82, 84, 72/86, 87, 102, 246, 101; 29/159 R

[56] References Cited

U.S. PATENT DOCUMENTS 2,940,501 6/1960 Kradoska ..... 72/82
3,087,531 4/1963 Pacak .
3,700,382 10/1972 Pacak .
3,893,818 7/1975 Mickus .
4,000,634 1/1977 Hixson .
4,064,724 12/1977 Armstrong .
4,144,732 3/1979 Franks et al. .

FOREIGN PATENT DOCUMENTS 440839 2/1927 Fed. Rep. of Germany ..... 72/82
1514582 2/1968 France .
2128372 10/1972 France .
2254383 7/1975 France .
2310173 12/1976 France .
221361 5/1942 Switzerland .

*Primary Examiner*—Lowell A. Larson
*Attorney, Agent, or Firm*—Browdy and Neimark

[57] ABSTRACT

Machine permitting a deep slitting in a periphery of non planar discs for obtaining wheels carrying a pneumatic tire, wherein the disc to be slit is driven in rotation on a floating support, that is a support which automatically compensates for flatness irregularities while slitting knurling means are mounted on a driving device which is rigidly supported on a fixed frame.

8 Claims, 5 Drawing Figures

MACHINE FOR THE DEEP SLITTING OF THE PERIPHERY OF NON PLANAR DISCS USED FOR PROVIDING WHEELS HAVING A PNEUMATIC TIRE

FIELD OF THE INVENTION

When it is desired to obtain, by a deep slotting or slitting operation of the periphery of non planar discs, flanges having the same thickness or a different thickness in order to thereafter conform these flanges for finally obtaining vehicle wheels carrying each a pneumatic tire, one sees rapidly that the deep slitting operation is very difficult to carry out, if not impossible, due to flatness deformations of the disc and to the inner tensions inherent to the disc constituent material. Moreover, the disc is subjected to deformations prior to the deep slitting operation since the central web of the wheel is stamped in order to place the hub forming the wheel support and also for providing this web with the desired shape in order to create for example a stylized wheel.

BACKGROUND OF THE INVENTION

Machines are known (such as that shown in U.S. Pat. No. 3,893,818 to Mickus) which permit a relatively deep slitting operation by exerting on the two side walls of the disc very high pressures which cause the area which is being slit to be practically plane, but such machines are complex and costly since they call for a considerable power supply and the known art does not ensure a slitting sufficiently deep for subsequently making vehicle wheels.

OBJECTS AND SUMMARY OF THE INVENTION

The present invention remedies these disadvantages by providing a machine on which the disc to be slit is driven in rotation on a rigid support, but in which the slitting rollers are mounted on a driving device adapted for angular displacement on a frame designed for this function.

According to the invention, there is also provided a machine on which the disc to be slit is driven in rotation on a floating support, viz. a support which automatically compensates for flatness irregularities of the disc, while the slitting roller or rollers are mounted on a driving device which is rigidly supported on a fixed frame. It is also possible to provide a machine by mounting the disc to be slit on a floating rotating support, and the slitting roller or rollers being also mounted on a driving assembly adapted for being displaced, according to needs, on a floating frame designed for this function.

According to the invention, the machine comprises a rigid frame on which are mounted two stub-shafts driven in rotation in synchronism, the two stub-shafts carrying a disc or roughcast to be deeply slit on its periphery, then the aforementioned frame carries at least one U-shaped support articulated on an axis, the floating assembly being subjected to the action of a motive member which permits following the deformations of the disc so as to cause at least one slitting roller, which rotates on a driven shaft, to forcibly groove and deeply cut into the disc periphery.

According to a further feature of the invention, the slitting rollers are mounted on stationary driving members, but the disc to be slit is mounted on a driving assembly which can be angularly displaced, that is to say an oscillating or floating support.

According to a further alternative embodiment of the invention, the machine can comprise also a floating mounting assembly of the disc to be slit which permits an angular displacement of the latter and also a device which is angularly displaceable, viz. floating, by the slitting roller or rollers.

According still to another feature of the invention, the slitting roller or rollers have a thickness "E" equal to seven to ten times the thickness "e" of the disc to be slit, the diameter "d" of the roller or rollers being between 30 and 70% of the outer diameter "D" of the disc, the identical angle "A" of each roller being more than 60°, and possibly up to 90°, the peripheral end of each roller being slightly blunted and non cutting, and during the working phase of the deep slitting operation, the working area of the roller or rollers is permanently in an oil bath which prevents jammings of the roller or rollers and prevents also the tearing off of metallic molecules on the disc.

Various other features of the invention will become more apparent from the detailed following description.

BRIEF DESCRIPTION OF THE DRAWINGS

Embodiments of the object of the invention are shown, by way of examples, in the accompanying drawings, wherein.

DETAILED DESCRIPTION OF THE INVENTION

Figure 1:
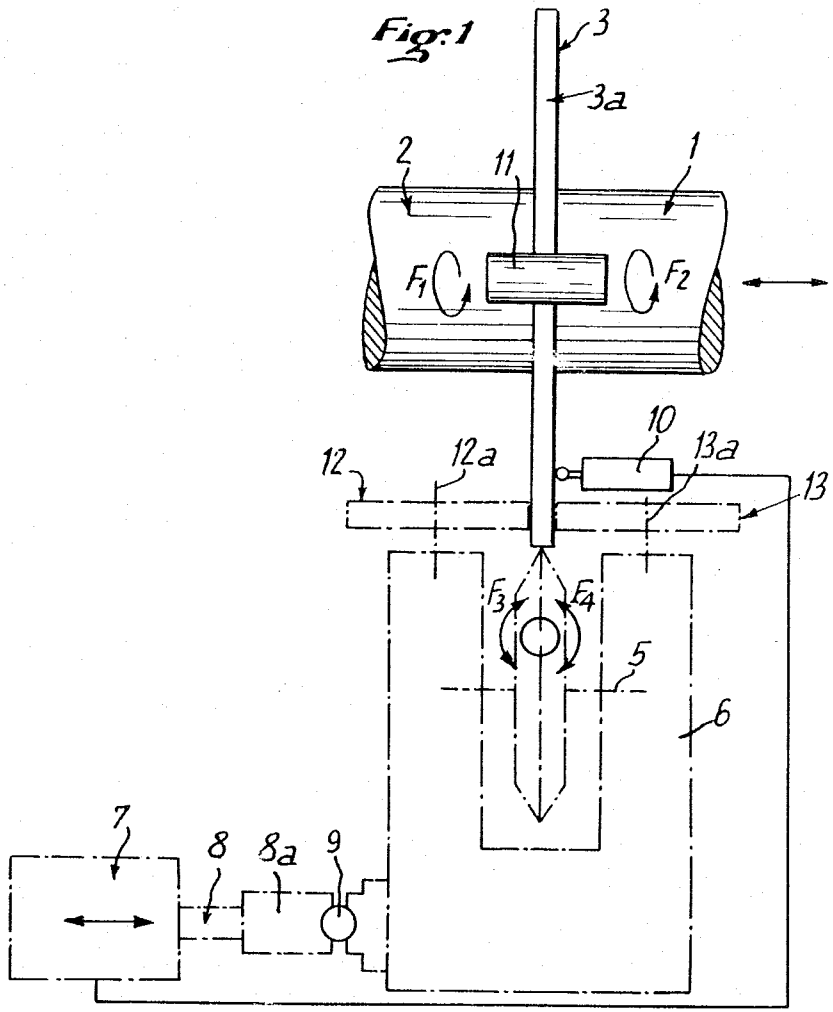
FIG. 1 is a schematic and partially sectional view of a first embodiment of the machine in which the slitting roller or rollers are mounted floating so as to compensate for deformations and inner tensions of the disc to be slit.

In the drawings, and particularly in FIG. 1 is shown schematically the working area of a disc slitting machine, said machine being generally of the "lathe" type. The two stub-shafts 1, 2 are mounted on the lathe center. Due to this fact, the stub-shafts 1, 2 can rotate at a predetermined speed in the directions of arrows F1 and F2 (FIG. 1). Thus, the shafts 1 and 2 retain rigidly a disc 3 the periphery 3*a* of which is to be deeply slit, with assistance of at least one slitting roller 4 which is mounted on a shaft 5 forcibly driven in rotation. The shaft 5 is mounted in bearings rigidly connected to a U-shaped support 6 fixed on axes 6*a* (FIG. 4) secured to the lathe bed so as to be angularly displaceable in the directions of arrows F3 and F4. Indeed, this U-shaped support 6 is placed under the control of a double action cylinder 7 the stem 8 of which carries at its end 8*a* a thrustball bearing 9 rigidly connected to the lower portion of the U-shaped support 6. The power supply of the double-action cylinder 7 is effected through an electronic sensor 10 sensing the disc 3 and acting on the feeding slides of the double-action cylinder 7.

The foregoing description shows the use of a double-action cylinder 7 of the hydraulic type, but in some cases the cylinder 7 can be an electro-magnetic device which can therefore be directly controlled by the electronic sensor 10 opening and closing the electrical feeding circuits of the electro-magnetic device.

Figure 4:
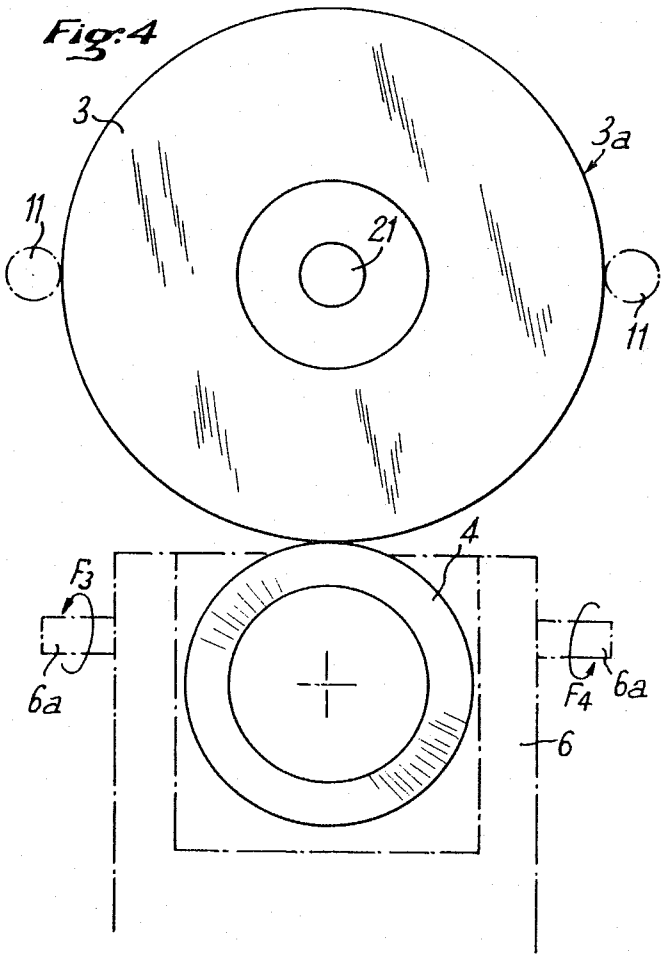
FIG. 4 is a schematic side elevation view corresponding to FIG. 3.

As is shown in FIGS. 1 and 4, the disc 3 is guided on its periphery by rollers 11 placed in the horizontal plane parallel to the central axis of the stub-shafts 1 and 2; the disc being maintained in the slitting area by rollers 12, 13 thereby providing the correct centering of the periphery 3*a* of the disc 3 with respect to the slitting roller 4. The centering rollers 12, 13 are mounted on spindles 12*a*, 13*a* which are rigidly connected to the U-shaped support 6.

The foregoing description shows therefore that the stub-shafts 1 and 2 forming the support of the disc to be slit are in a fixed position, but due to the possibility of a limited angular displacement of the U-shaped support 6 and of the correct maintenance in position of the periphery 3*a* of disc 3 by the rollers 12, 13 flatness differences of the disc 3 and irregularities caused by the release of inner tensions during the slitting operation can be easily taken up.

Figure 2:
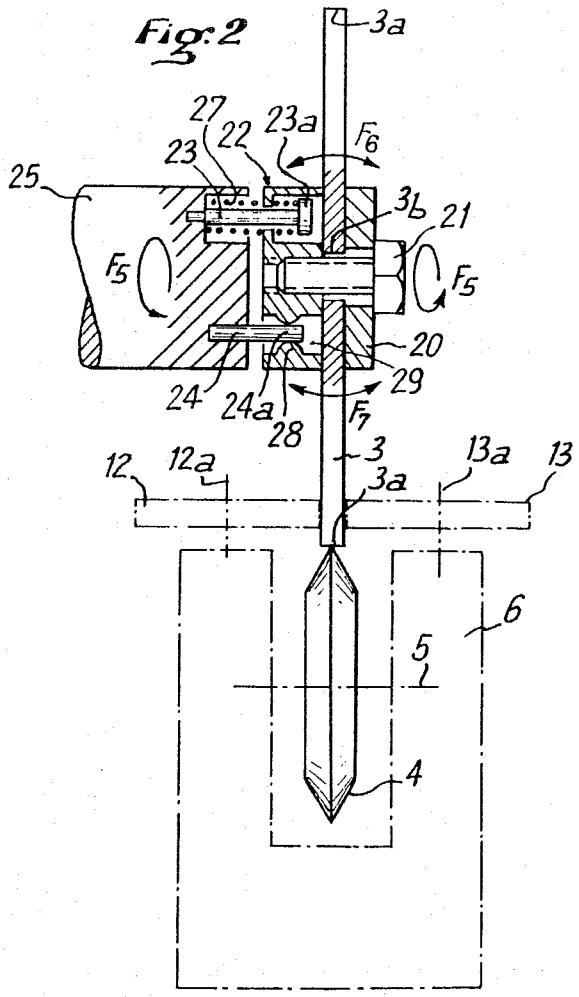
FIG. 2 is a partially sectional schematic elevation view showing the machine in which the disc is mounted on a floating support while the slitting roller or rollers are mounted on a stationary frame.

In FIG. 2 is shown in the U-shaped support 6 of the machine which carries a shaft 5 driven in rotation and on which is mounted at least one slitting roller 4. As in the preceding case, the disc 3 is held on its periphery 3*a* by rollers 12, 13 mounted loose on spindles 12*a*, 13*a*. On the contrary, the disc 3 through of which extends a central channel 3*b* and which is clamped by a flange 20 by means of a bolt 21 on a hub 22 is guided and driven in rotation through rods 23, 24 rigidly connected to a rotating shaft 25 which rotates for example in the direction of arrow F5. Among the rods 23, 24, the rod or rods 23 are each formed with a head 23*a* providing the possibility of housing a helical spring 27 between the shaft 25 and the hub 22, while the rod or rods 24 simply permit a guiding of the hub 22 relative to the shaft 25 due to the fact that the ends 24*a* of each rod 24 are placed between a protruding ring 28 provided inside the recess 29 formed in the hub 22. Thus, it is possible to obtain very slight displacements of the disc 3 to the right and to the left in the directions of arrows F6 and F7 for automatically taking up the deformations of the disc or for compensating for the release of the metal inner tensions. Moreover, it is possible to provide also, as in FIG. 1, an electronic sensor (not shown) which acts thereafter on the hub 22 via a hydraulic cylinder or similar member.

With such a machine, it is therefore easy to carry out a deep slitting of the periphery 3*a* of the disc 3.

Figure 3:
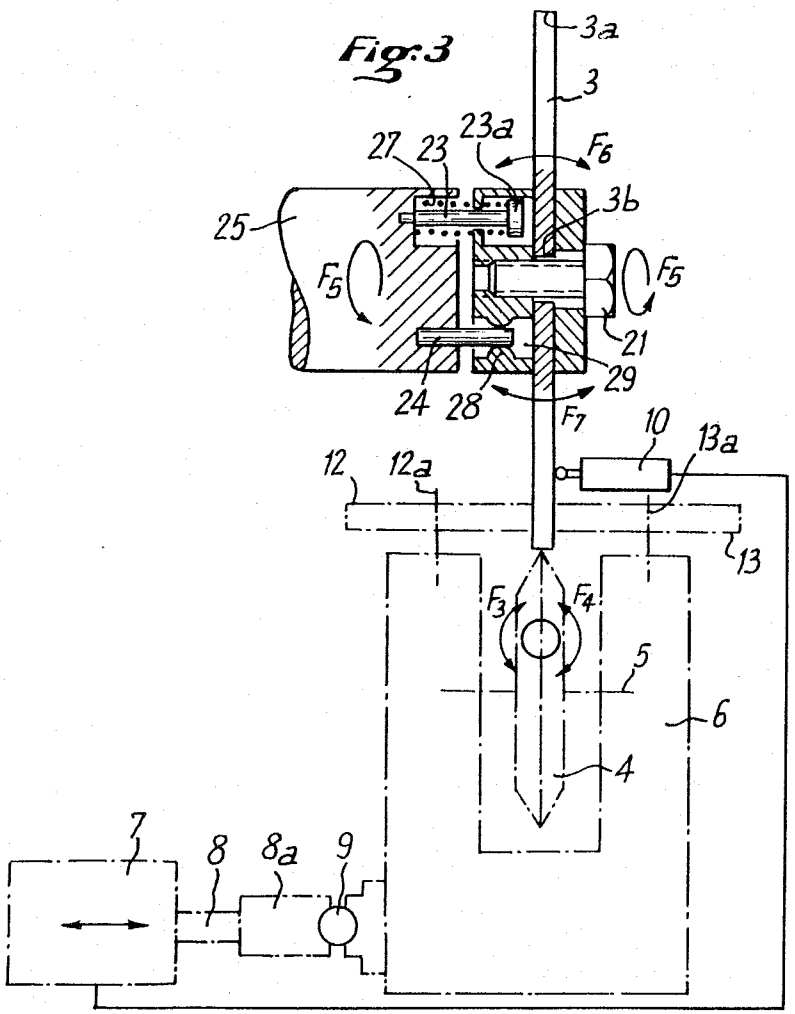
FIG. 3 is a schematic elevation view of a third embodiment of the machine in which the disc to be slit is mounted on a floating rotating driving device, as well as the slitting roller or rollers the support of which comprises a so-called floating suspension device.

In FIG. 3, the mounting assembly of the roller 4 is identical to that of FIG. 1 and is therefore indicated with the same references, while the mounting assembly of the disc 3 is identical to that described above with reference to FIG. 2 and is therefore indicated by the same references. Thus is obtained a floating mounting of the roller 4 and a floating mounting of the disc 3 providing an automatic and perfect take up of all the flatness deformations of the disc 3 as well as a compensation for any release of the inner tensions of the disc 3 during the slitting of its periphery 3*a*.

Therefore, the machine thus described permits an easy and rapid slitting of the periphery of the disc over variable depths which can be between, for example, 70 and 180 mm.

Although hydraulic and mechanical devices have been described for holding the roller 4 or the disc 3 in order to provide a floating mounting, it is possible to use, instead of the hydraulic device a pneumatic, or even an electrical device, by replacing the double-action cylinder 7 and the guiding device formed by the hub 22 and the rods 23, 24 by electromagnets, small hydraulic or pneumatic jacks for providing the same service.

Likewise, the controlling rollers 11, 12, 13 can also be mounted on shafts maintained by very sensitive means, for example of the electrical type, in order to control the exact position at any working moment of the disc 3 during the slitting operation. It should also be pointed out that the sensors provided to control the support 22 of the disc 3 as well as the support of the at least one roller 4 can be electrical, hydraulic, pneumatic, or others.

Figure 5:
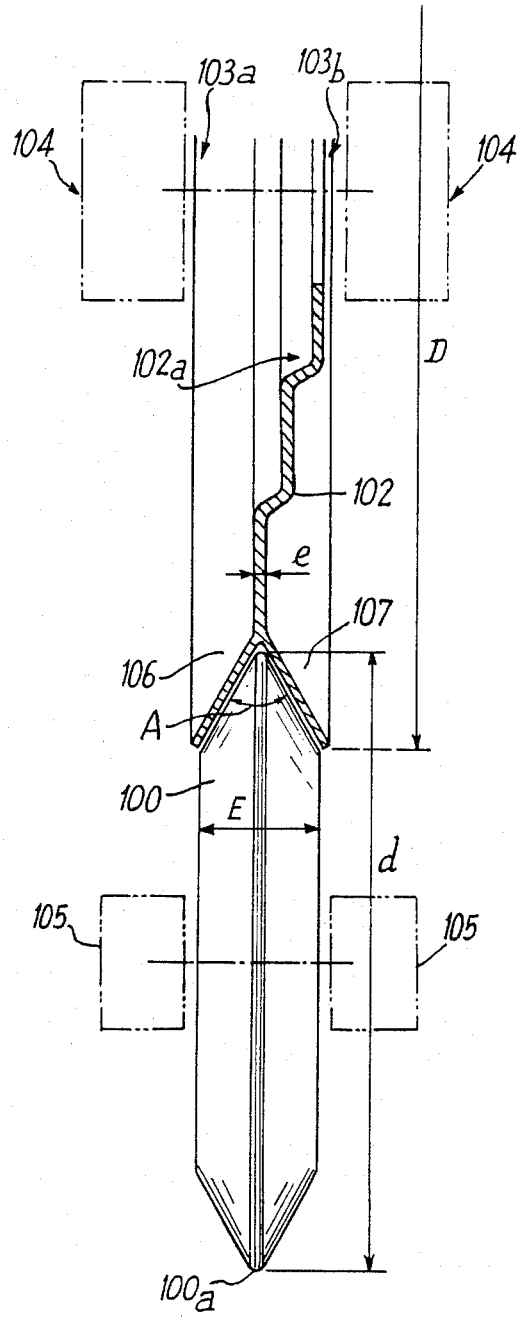
FIG. 5 shows an elevation sectional view of the disc while being subjected to a deep slitting operation and, seen from the outside, one of the slitting rollers used on the machine.

As indicated hereabove, the machine described is adapted and designed for a deep slitting of a disc at the chosen position, whatever the flatness of the disc and whatever the inner tensions which are released when the deep slitting operation is carried out. As shown in FIG. 5, the machine needs, according to the invention, at least one roller 100 having a large thickness "E" which is substantially between eight and ten times the thickness "e" of the metal sheet to be slit and which is a metal sheet forming a wheel 102 the central web 102*a* of which has been previously stamped for providing it with the desired and convenient shape.

The wheel 102 is, as hereabove described, mounted on two stub-shafts 103*a*, 103*b* driven by floating members illustrated here by blocks 104. It should be noted that the outer diameter of the roller 100 shown at "d" is at least equal to the third of the outer diameter "D" of the wheel 102. However, it should be considered that "d" is most often between 35 and 40% of "D". In some cases, the diameter "d" of the roller can be equal to 7/10 of the diameter "D" of the disc 102.

Moreover and as shown in FIG. 5, the angle "A" of the roller 100 is between 60° and 90° and has a peripheral end shape 100*a* which is not sharp but on the contrary slightly rounded.

Thus, the disc 102 is caused to follow the roller 100 since the latter is mounted, as previously discussed, on oscillating or floating members 105 providing a permanent centering and allowing this obtaining of the deep slitting of the ring of the disc 102 by creating flanges 106, 107 of the same thickness which can be easily conformed, when the deep slitting operation is completed, in order to finally provide a support for a pneumatic tire.

During the slitting operation, the working area is held by mechanically driven rollers, or rollers driven by an electronic or electrical control, in order to easily and immediately compensate for the flatness faults and the inner tensions.

During the slitting operation, the working area is permanently supplied with a special oil as coolant and having characteristics which are a function of the material to be slit, in order to avoid jamming of the roller 100 with respect to the disc, or the tearing off of metallic molecules in the areas of lesser resistance. Most often there is used an oil for a fine cutting having a viscosity of 380 centipoises at a temperature of 20° C.

Although there is mentioned in the foregoing description the presence of a single slitting roller 100, the work can be effected simultaneously by two or several rollers, the rollers having the hereabove described characteristics and working in an oil bath as explained in the foregoing.

The slitting rollers are made of a hard material which can be a special steel and even in some cases a synthetic special resin.

I claim:

1. A machine permitting deep slitting in the periphery of a non-planar disc to obtain a wheel provided for mounting a pneumatic tire thereon, comprising:

support means for rotatively supporting the disc;

slitting roller means positioned at the disc periphery for the deep slitting of the disc, said roller means having an axis of rotation; and means for driving the slitting roller means, at least one of said support means and said driving means being carried by means for automatically compenstating for flatness irregularities of the disc said compensating means including means for oscillatably supporting said roller means about an axis normal to said axis of rotation.

2. A machine according to claim 1, wherein the machine comprises a rigid frame on which are mounted two stub-shafts rotatably driven in synchronism, said two stub-shafts carrying the disc to be deeply slit on its periphery, said compensating means including at least a U-shaped support articulated on an axis parallel to said axis of rotation, said oscillatably supporting means being subjected to action of a motive member which permits the following of deformations of the disc so as to cause said slitting roller means to forcibly groove and deeply cut into the periphery of said disc.

3. A machine according to claim 2, wherein the motive member causes an angular displacement of said roller means, said motive member comprising an electronic sensor acting, via an electrical connection, on slides of a double action cylinder, thereby controlling via a thrust-ball bearing an angular displacement of the U-shaped support which carries said roller means.

4. A machine according to claim 2, wherein said compensating means further includes a rotating shaft, and a hub coupled to said disc, one end of said shaft carrying guiding rods which cooperate with said hub to permit angular displacement thereof, said hub carrying in its center the disc to be slit, at least one rod including resilient means for returning said hub to an idle position after an angular displacement.

5. A machine according to claim 4, wherein movement of one of said hub and said U-shaped support is controlled by sensors.

6. The machine according to claim 1 wherein said driving means is mounted on said compensating means, and said disc is driven in rotation on a fixedly mounted support.

7. A machine for deep slitting the periphery of non planar discs for obtaining wheels carrying a pneumatic tire, comprising:

means for rotating said disc;

means for supporting said rotating disc for movement having two degrees of freedom;

means for automatically compensating for the flatness irregularities in, and the release of the inner tensions of the material forming, the disc when the deep slitting operation is carried out;

at least one slitting roller means positioned at the disc periphery, said roller means being mounted in a driving device supported on a fixed frame, said at least one roller means having a thickness "E" equal to seven to ten times the thickness "e" of the disc to be split, the diameter "d" of said roller means being between 30% and 70% of the outer diameter "D" of the disc, the working area of said roller means being disposed in an oil bath, whereby jamming of said roller means and tearing off of metallic molecules of the disc is avoided.

8. A machine according to claim 7, wherein the oil in said bath facilitates fine cutting and has a viscosity of substantially 380 centiposes at a temperature of 20° C.

* * * * *